US006755392B1

(12) United States Patent
Phillips

(10) Patent No.: US 6,755,392 B1
(45) Date of Patent: Jun. 29, 2004

(54) NAIL EXTRACTOR

(75) Inventor: Stephen W. Phillips, Bergen, NY (US)

(73) Assignee: LMP Technologies, LLC, Avon, NY (US)

( * ) Notice: Subject to any disclaimer, the term of this patent is extended or adjusted under 35 U.S.C. 154(b) by 87 days.

(21) Appl. No.: 09/717,366

(22) Filed: Nov. 20, 2000

(51) Int. Cl.[7] ..... B66F 15/00
(52) U.S. Cl. ..... 254/18
(58) Field of Search ..... 254/18, 20, 28, 254/100, 231; 12/16; 29/700, 426.5; 112/30; 227/63; 81/53.2; 145/1

(56) References Cited

U.S. PATENT DOCUMENTS

| | | | | |
|---|---|---|---|---|
| 33,218 A | | 9/1861 | Towle | |
| 401,113 A | | 4/1889 | Baumeister | |
| 1,683,796 A | | 9/1928 | Pearce | |
| 2,796,232 A | | 6/1957 | Steffanus | |
| 3,106,233 A | | 10/1963 | Wolny | |
| 3,457,812 A | | 7/1969 | Wagner, Jr. | |
| 3,529,497 A | * | 9/1970 | Brooks | 81/52.35 |
| 3,626,935 A | * | 12/1971 | Pollock | 128/83 |
| 3,735,650 A | | 5/1973 | Weng, Jr. | |
| 3,750,500 A | | 8/1973 | Peterson | |
| 4,007,913 A | | 2/1977 | Aldrich | |
| 4,204,308 A | | 5/1980 | Marling | |
| 4,389,913 A | | 6/1983 | Drouin et al. | |
| 4,482,131 A | * | 11/1984 | Hamilton | 254/18 |
| 5,141,205 A | | 8/1992 | Iwai et al. | |
| 5,680,800 A | * | 10/1997 | Sharpe | 81/177.2 |
| 5,906,146 A | | 5/1999 | Arlen | |
| 5,950,507 A | * | 9/1999 | Wolfe | 81/177.2 |
| 6,267,025 B1 | * | 7/2001 | Sand et al. | 81/53.2 |

FOREIGN PATENT DOCUMENTS

| | | |
|---|---|---|
| JP | 4-152074 | 5/1992 |

* cited by examiner

*Primary Examiner*—Lee D. Wilson
(74) *Attorney, Agent, or Firm*—Brown & Michaels, PC; Eugene Stephens & Assoc.

(57) ABSTRACT

A nail extractor advances a spinning drill tube into wood closely around the head of a nail to be extracted. As the drill tube advances into the wood around the nail, it compresses a drilled core of wood between the nail and the inside of the drilling tube. As this compressed core of drilled wood deepens or lengthens, it engages and rotates the nail, spinning the nail free from the wood in which it has been embedded. The spinning drill tube can then be removed with the nail and the compressed core of drilled wood, without touching the nail with the extractor tool. The nail is then preferably ejected from the drill tube by advancing an ejector pin into the drill tube.

13 Claims, 6 Drawing Sheets

NAIL EXTRACTOR

TECHNICAL FIELD

The art of pulling or removing nails from wood.

BACKGROUND

Restoration and reconstruction work in buildings often requires removal of trim wood around doors, windows, cabinets and baseboards. In many cases, the trim wood is later replaced, and since such trim wood is usually held in place with nails, much time can be spent removing the nailed trim without splitting it and otherwise pulling or removing the nails from the trim so that the trim can be reused.

Such nail removal is made more difficult by the fact that trim wood is usually held in place with finishing nails that have small heads only slightly larger in diameter than the nail shank. Also, finishing nails are often counter-sunk into the wood, so that a tool used to remove the nail must be dug into the wood to get a grip on the nail. This, and any prying force used, can damage the wood around the nail.

Trim wood can be pried loose from its mounted position by carefully exerting prying pressure to pull the nails loose from the wood under the trim in which they are embedded, but this can be difficult to accomplish without splitting or otherwise damaging the trim wood. Nails can then be driven back out of the trim wood from the backside of the trim for easy removal, but this also can split the trim wood around the edge of a countersunk nail head.

Often, the best place to locate nails for refastening removed trim wood in place is the same place that its original fastening nails were located. Thus, replacement nails often re-secure trim wood in place by being driven back into the original holes.

Altogether, dealing with nail problems in removing and replacing wood trim in buildings can consume much of a worker's time. The invention of this application aims to reduce the labor involved and make nail extraction fast and convenient, with minimal damage to the trim wood being removed. Once the invention presents an effective way of extracting finishing nails, it becomes clear that the invention can be used anywhere that finishing nails have been deployed. This can include nail removal from furniture and other constructions that do not involve trim wood in buildings. Although the problem of finishing nails in trim wood motivated the inventive nail extractor, its operation makes it clear that it can also be used for extracting the bodies of screws whose heads have broken off.

SUMMARY

The nail extractor and extraction method of this application involves a smooth walled tube having an inside diameter slightly larger than the diameter of the heads of nails to be removed. The tube is spun and pressed into the wood around the nail head so that the tube drills into the wood and compresses a core of drilled wood against the embedded nail. When the tube has been spun and pressed into the wood to a sufficient depth, the compressed wood inside the tube grips and spins the nail loose so that the nail is quickly and easily extracted or withdrawn from the wood.

The inventive extractor preferably includes an ejector that can be advanced into the tube to eject the extracted nail from the tube. The necessary elements to accomplish the withdrawal of the nail and its ejection from the drilling tube are preferably combined in a sleeve that holds the drilling tube at its forward end and has an internal thread engaging an external thread of an ejector rod that is chucked into an electric drill. These elements are preferably arranged so that when the drill operates in a forward direction, the ejector rod retracts and the tube spins clock-wise into the wood to extract the nail. Then when the outer sleeve of the extractor is held against rotation and the drill rotates in a reverse direction, the ejector rod advances an ejector pin into the drilling tube to eject the nail and the drilled wood core from the drilling tube.

The extraction and ejection of a nail is accomplished without any contact between the extractor and the nail itself. This avoids all jaws or grippers that must physically engage the nail to accomplish its extraction, and instead, the drilled core of wood compressed within the drilling tube accomplishes the necessary nail gripping and also spins the nail loose from its anchorage so that it is easily withdrawn from the wood.

DRAWINGS

DETAILED DESCRIPTION

Figure 1:
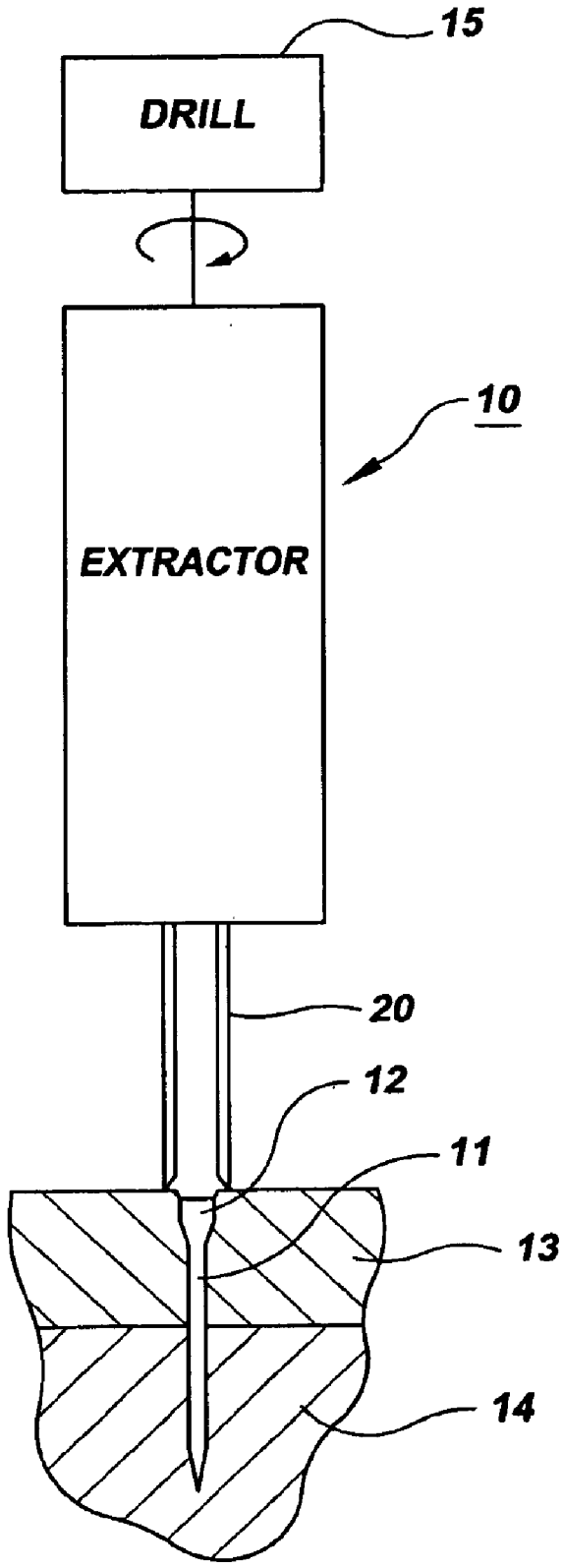
FIGS. 1–4 are schematic views of the operation of the inventive nail extractor shown beginning the nail extraction process in FIG. 1, drilling into wood around the nail in FIG. 2, extracting the gripped nail in FIG. 3, and ejecting the extracted nail from the drilling tube in FIG. 4.

The way the inventive nail extractor works is best shown in the schematic views of FIGS. 1–4. Extractor 10 is preferably powered by an electric drill 15 so as to spin or rotate tube 20. A finishing nail 11 with a head 12 is slightly countersunk into a trim board 13 that is fastened to a substrate 14 by nail 11. Board 13 need not be a trim board, and can be a furniture part or other construction secured with nail 11.

Figure 2:
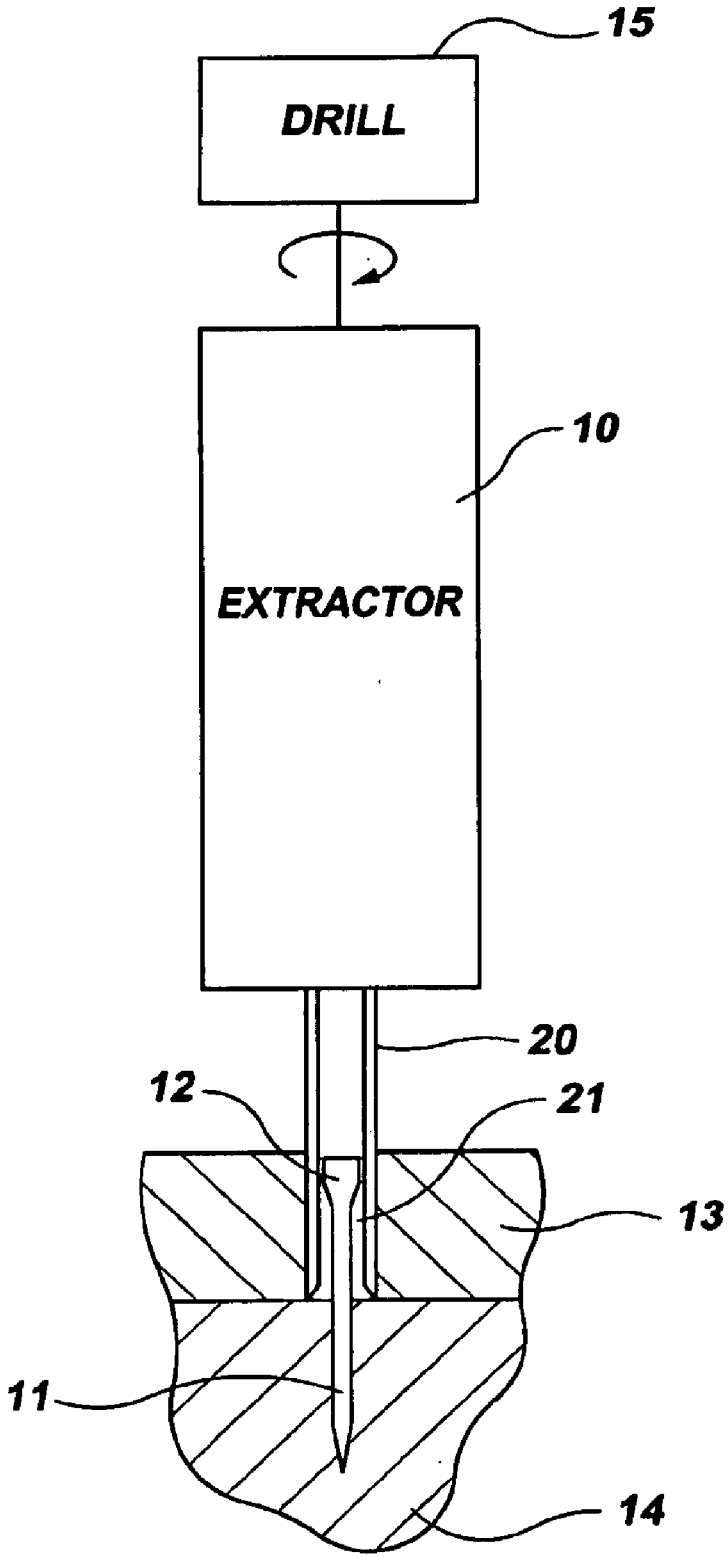

To remove nail 11, drill or extractor tube 20 is positioned to surround nail head 12 and is pressed against trim wood 13 as drill 15 is actuated to spin tube 20. As this occurs, a worker pushes on drill 15 to press spinning tube 20 into wood 13, as shown in FIG. 2.

Figure 3:
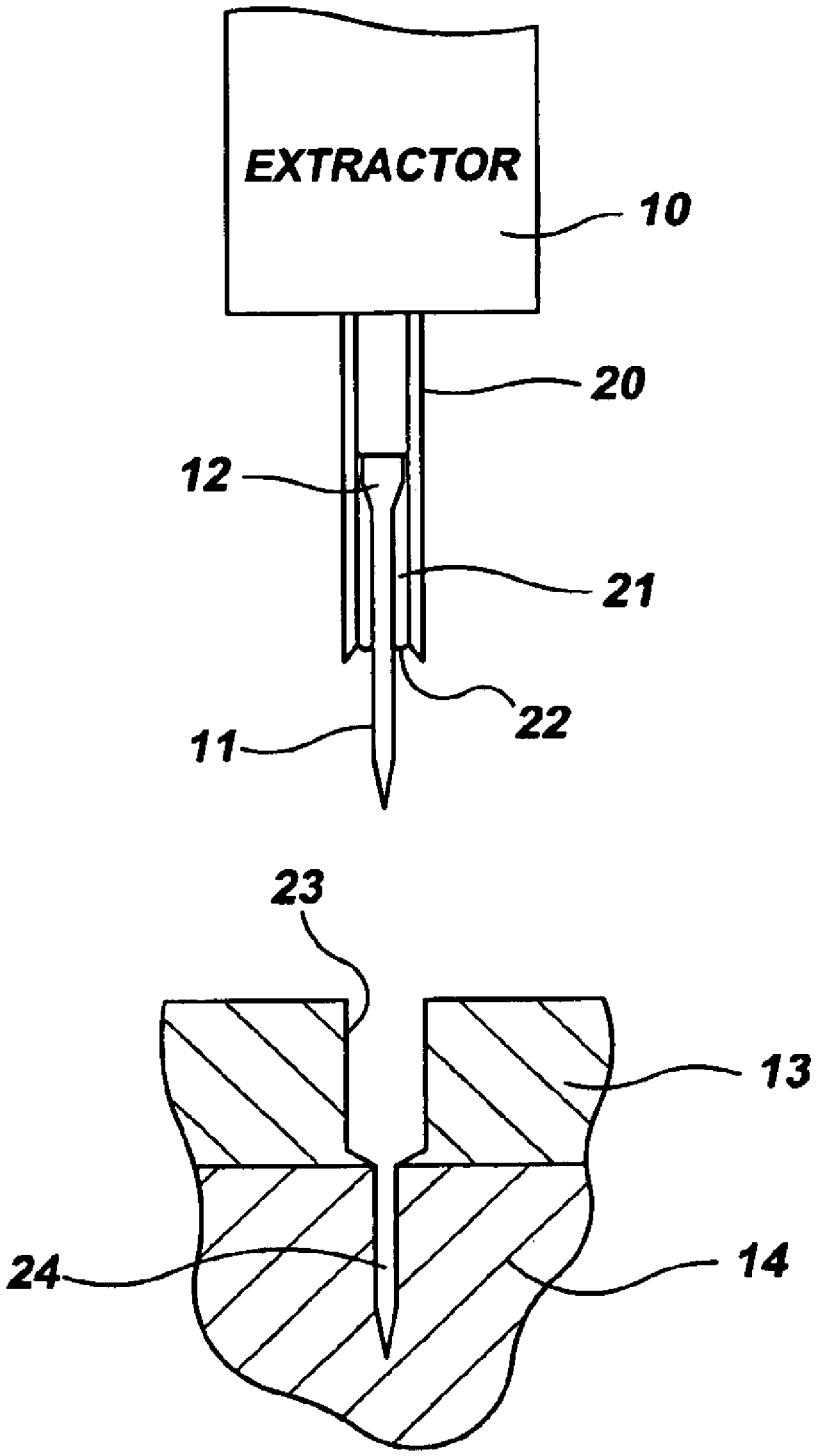

As drill tube 20 is spun and pressed into wood 13, it drills into wood 13 around nail head 12 and the shank of nail 11, as illustrated. As spinning tube 20 penetrates wood 13, it drills out and compresses a core 21 of wood surrounding nail 11. At some depth of penetration, the compressed wood core 21 drilled of wood 13 inside of tube 20 grips nail 11 sufficiently to spin nail 11 loose from its anchorage in substrate 14. The penetration depth of extractor tube 20 that sufficiently grips nail 11 to begin spinning it varies with circumstances that include the size and length of nail 11 and the kind of wood involved. This point can be reached within board 13, or within substrate wood 14. Tube 20 must be long enough so that it can penetrate to a sufficient depth to grip nail 11 with compressed wood core 21, but this usually occurs before tube 20 reaches the pointed end of nail 11. Once nail 11 is gripped and spun by the rotation of tube 20 and drilled wood core 21, nail 11 is loosened from substrate 14 and is readily withdrawn, as shown in FIG. 3.

When extracted from wood 13 and 14, nail 11 usually extends beyond a cutting end 22 of tube 20, as illustrated. This can vary with the tool operator, however, who may sense the loosening of nail 11 and quickly withdraw it, or who may push drill tube 20 deeper than necessary into wood 13 and 14.

The hole remaining in the wood upon extraction of nail 11 includes a drilled socket 23 extending into wood 13, and possibly into substrate wood 14, where drill tube 20 drilled in around nail head 12. A nail hole 24 may also extend beyond bored socket 23, representing the extent of nail 11 beyond tube 20, which is spun loose from wood 14 once nail 11 is gripped and rotated by compressed wood core 21. If trim wood 13 is remounted, socket hole 23 is preferably filled with wood putty or the like. Also, a nail larger than nail 11 can be driven into socket 23 to hold a remounted board 13 in place.

Figure 4:
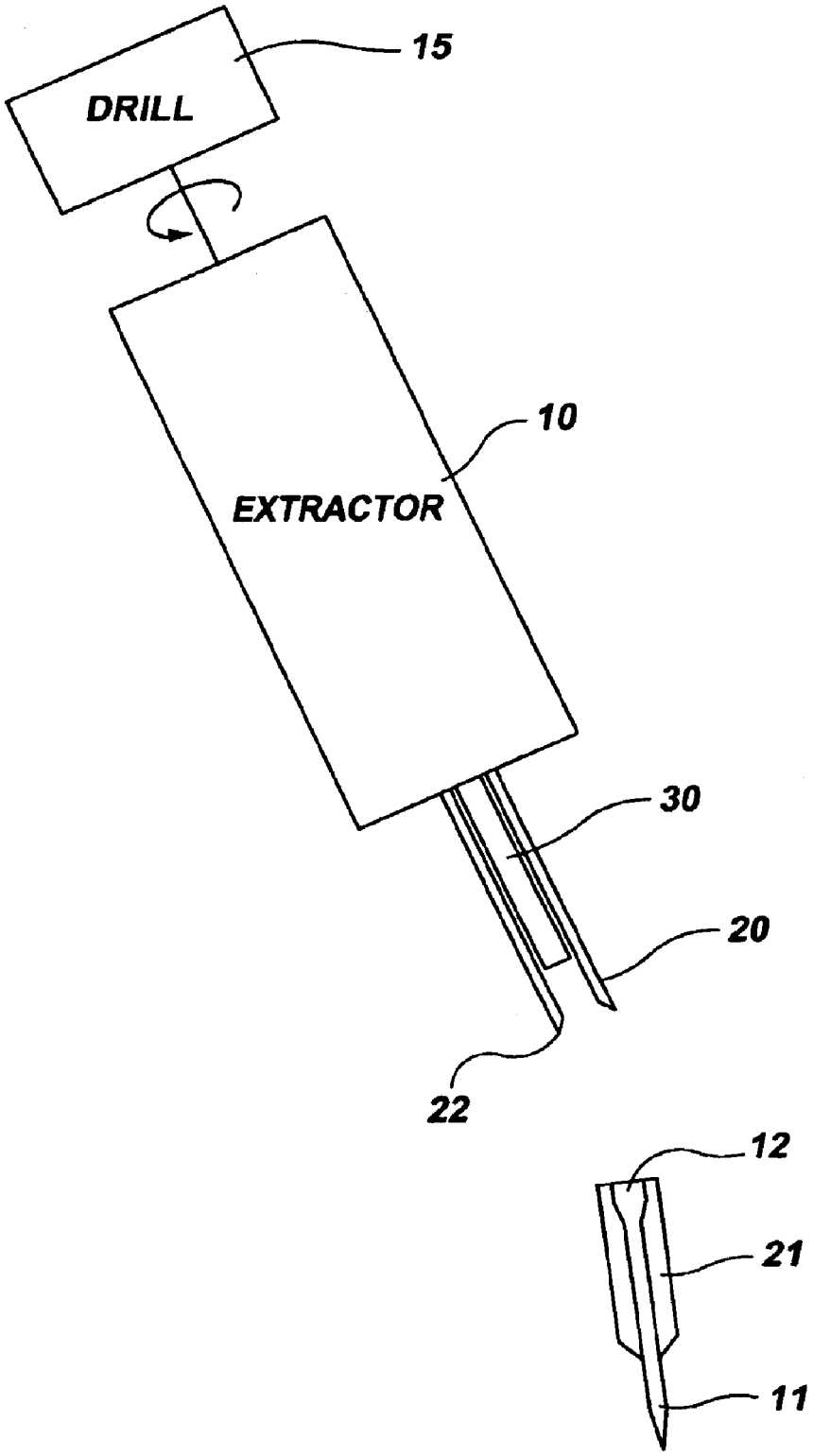

FIG. 4 schematically shows the ejection of nail 11 and drilled wood core 21 from extraction tube 20 after nail 11 is extracted from the wood in which it was embedded. This is preferably accomplished by holding extractor 10 from rotating while reversing drill 15 to advance ejector rod 30 into drill tube 20. This pushes nail 11 and drilled wood core 21 out of the open end 22 of drill tube 20, as illustrated.

Figure 5:
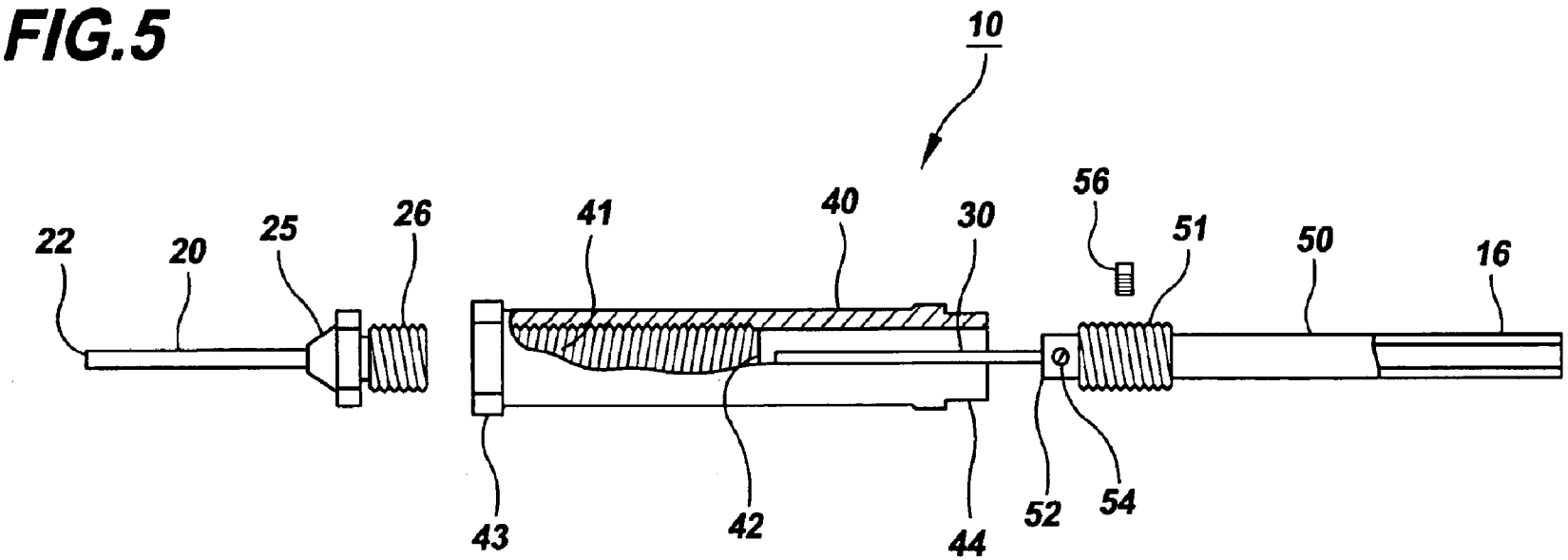
FIG. 5 is an exploded and partially cut away view of a preferred embodiment of the inventive nail extractor.

A preferred arrangement of elements combined in extractor 10 is shown in the exploded view of FIG. 5. These elements include a sleeve-like body 40, drive rod 50, ejector rod 30, and drill tube 20. The assembly of these elements preferably allows relative axial motion between drive rod 50 and body sleeve 40.

Drill tube 20 is preferably formed of tubing having a smooth interior and exterior wall. Stainless steel is available for drill tube 20 and is preferred for being strong and having a thin wall. The open, cutting end 22 of drill tube 20 can be sharpened to improved its cutting ability as it is pressed into wood while spinning. An internal bevel sharpened on cutting end 22 is preferred so that drilled wood is compressed inward around a nail surrounded by tube 20 as it advances into wood. A serrated or saw tooth cutting edge at tube end 22 is possible but not necessary. An external bevel sharpened on cutting end 22 can also work, as can no sharpening at all. Hardening the cutting end of the tube can prolong its cutting ability, whether the tube is sharpened or not.

Tube 20 preferably has a wall thickness as thin as possible to accomplish the necessary drilling task. One reason for this is to make the drill hole around a nail head as small as possible, and another is that a thin walled tube is easier to press into wood than a thicker walled tube. The tube wall cannot be so thin that the tube is in danger of collapsing or breaking when the spinning tube is pressed into wood, though.

The inside diameter of tube 20 is preferably slightly larger than the diameter of a head 12 of a nail to be extracted. Since finishing nails come in different sizes, drill tubes 20 having different inside diameters are also preferably available. Each size of drill tube is preferably press fit into a mounting collar 25 having a screw thread 26 mating within an internal thread 41 formed inside sleeve 40. This allows a suitable size of drill tube 20 to be screwed to a forward end of extractor body 40 and allows convenient interchange between sizes of drill tubes.

Mounting collar 25 holding drill tube 20 preferably has a conical entrance cavity 26 to guide ejector rod 30 into the inside of drill tube 20. A rear end 19 of drill tube 20 can seat against a step 28 formed at the intersection of conical bore 26 and a drill tube receiving bore 27 formed in mounting collar 25. Drill tube 20 preferably has a press fit into bore 27.

Internal thread 41 preferably extends from a forward end 43 of sleeve 40 to a stop 42 arranged toward a rear end 44 of sleeve 40. This provides not only threads necessary to receive threads 26 of tube mounting collar 25, but also to receive threads 51 of drive rod 50. Drive rod 50 can then be inserted rearwardly into forward end 43 of sleeve 40 before tube mounting collar 25 is threaded onto sleeve 40. Drive rod 50 is long enough so that its hex-shaped drive end 16 emerges from rear region 44 of sleeve 40 so that hex end 16 can be manipulated to engage drive rod threads 51 with sleeve threads 41 and move drive rod 50 rearwardly of sleeve 40. The inner engagement of drive rod threads 51 with internal threads 41 of sleeve 40 allows axial relative movement to occur in response to relative rotation between drive rod 50 and sleeve 40.

Figure 6:
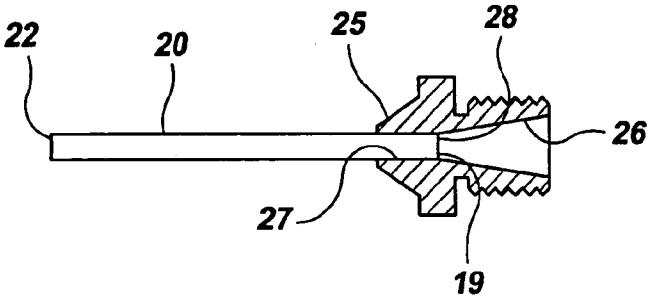
FIG. 6 is a partially sectioned view of a preferred embodiment of the drilling tube for use with the extractor of FIG. 5.
Figure 7:
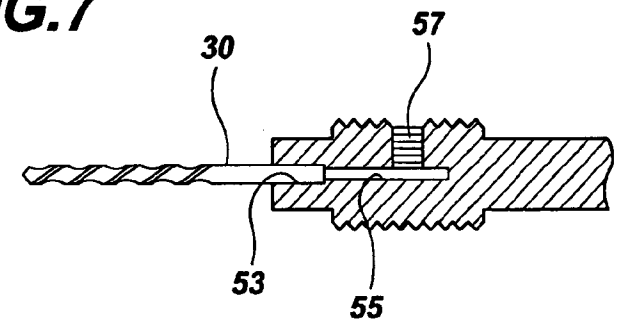
FIG. 7 is a partially sectioned, fragmentary view of an ejector rod for the extractor of FIG. 5.

The hex-shaped drive end 16 of drive rod 50 conveniently serves for chucking drive rod 50 into electric drill 15. Ejector rod 30 is mounted in a forward end 52 of drive rod 50 and can be formed of drill rod or of a conventional twist drill bit, as best shown in FIG. 6. Forward end region 52 of drive rod 50 preferably has a larger diameter socket 53 intersected by a set screw 54, and a smaller diameter socket 55 intersected by another set screw 56 that can be threaded into tapped hole 57. This allows two different sizes of drill bits or rods 30 to serve as ejector rods. A smaller diameter rod can be inserted into bore 55 and held by set screw 57, and a larger diameter rod can be inserted into bore 53 and held by set screw 54.

For ergonomically suiting extractor 10 to the habits of users of electric drills, threads 51 and 41 are preferably left handed. This causes drive rod 50 to retract within sleeve 40 and retract ejector pin 30 rearwardly as drill 15 is rotated in a forward direction. Frictional resistance of tube 20 drilling into wood around a nail can cause sleeve 40 to advance relative to drive rod 50 and insure that ejector pin 30 is retracted from tube 20. Retraction of ejector pin 30 is necessary, of course, for tube 20 to drill into wood around nail 11 without any interference from an ejector pin.

Once a nail is extracted, it is held tightly within drill tube 11 by compressed wood core 21. At this point, the worker holds sleeve 40 against rotation while reversing drill 15, which then drives shaft 50 forward within sleeve 40 to advance ejector pin 30 into drill tube 20. This forces the extracted nail 11 and its surrounding drilled wood core 21 out of drill tube 20, as shown in FIG. 4.

The operation of nail extraction can work just as well with right handed threads 41 and 51 so that drill 15 is driven in reverse to advance drill tube 20 into wood around a nail, and then is driven in a forward direction to advance ejector pin 30 into drill tube 20. This may seem backward to the customary uses of electric drills, but this may work better if the extractor tool is also used for extracting the bodies of screws with heads broken off.

When a different size extractor tube 20 is chosen for removal of a different size finishing nail, it may be necessary to also change the size of ejector rod 30. Preferably ejector rod 30 is chosen to be only slightly smaller in outside diameter than the inside diameter of a matching drill tube 20. Using a smaller than necessary ejector rod 30 can risk rod breakage in ejecting larger nails from drill tube 20.

I claim:

1. A nail extractor comprising:

a. a drill tube mounted in a forward end of a body configured to be chucked in a drill capable of spinning the tube;

b. the drill tube having a wall that is smooth and cylindrical on both inside and outside surfaces;

c. the inside surface of the tube wall having a diameter slightly larger than a head of a nail to be extracted; and d. the tube being configured to extract the nail without contacting the nail; and e. the tube wall being structured to withstand being spun by a drill while manually pressed into wood surrounding the nail; to withstand drilling around the nail to a depth sufficient to drill a core of wood contained within the tube; to compress the drilled core between the tube wall and the nail; to rotate the drilled and compressed core with the tube; to press the rotating drilled core against the nail with sufficient force to grip the nail and spin the nail loose; and to extract the spinning nail and the drilled core from a hole drilled around the nail by the tube.

2. The nail extractor of claim 1 wherein the free end of the tube is sharpened.

3. The nail extractor of claim 1 wherein the body includes a sleeve with an internal thread engaging an external thread of a rod; the sleeve is configured to hold the drill tube, and the rod is configured to be chucked into the drill so that the rotation of the rod by the drill can rotate the sleeve and the tube to spin the tube into the wood.

4. The nail extractor of claim 3 wherein the rod mounts an ejector pin having an outside diameter slightly smaller than the inside surface of the tube, and the sleeve is movable axially of the rod so that when the sleeve is held against rotation while the rod is rotated in a predetermined direction the rod moves the ejector pin into the tube and ejects from the tube the nail and the compressed wood surrounding the nail.

5. The nail extractor of claim 4 wherein the internal and external thread is left handed so that forward rotation of the drill retracts the rod within the sleeve while the sleeve spins the tube into the wood, and reverse rotation of the drill while the sleeve is held against rotation advances the rod into the tube.

6. The nail extractor of claim 4 wherein the ejector pin is a twist drill bit mounted in a socket in a forward end of the rod.

7. A nail extractor comprising:

a. a drive rod having one end configured to be chucked in a drill and an opposite end configured to receive and mount an ejector pin;

b. the drive rod having an external thread engaging an internal thread of a sleeve surrounding the drive rod and movable axially of the drive rod as relative rotation occurs between the external and internal threads; and c. the sleeve mounting a nail extractor tube having an open end.

8. The nail extractor of claim 7 wherein the ejector pin is a twist drill bit held in a socket of the drive rod by a set screw, the drill bit having a smaller outside diameter than an inside diameter of the tube.

9. The nail extractor of claim 7 wherein the open end of the tube is sharpened.

10. The nail extractor of claim 7 wherein the internal and external threads are left handed.

11. The nail extractor of claim 7 wherein the tube is mounted in a cap that threads to the sleeve.

12. The nail extractor of claim 7 wherein the tube is available in a plurality of different diameters to fit different nails, and each of the tubes is mounted in an individual cap that threads to the sleeve.

13. The nail extractor of claim 12 wherein the drive rod has a socket with a plurality of inside diameters to receive a corresponding plurality of ejector pins having different diameters each respectively smaller than inside diameters of the tubes mounted in caps threaded to the sleeve.

* * * * *